United States Patent [19]

Fujii

[11] 4,218,691

[45] Aug. 19, 1980

[54] RECORDING APPARATUS WITH IMPROVED COUNTER ELECTRODE

[75] Inventor: Tadashi Fujii, Yokohama, Japan

[73] Assignee: Ricoh Company, Ltd., Tokyo, Japan

[21] Appl. No.: 937,162

[22] Filed: Aug. 28, 1978

[30] Foreign Application Priority Data

| | | | |
|---|---|---|---|
| Aug. 30, 1977 | [JP] | Japan | 52-104053 |
| Sep. 27, 1977 | [JP] | Japan | 52-115760 |
| Dec. 3, 1977 | [JP] | Japan | 52-145464 |

[51] Int. Cl.[2] ..... G03G 15/08

[52] U.S. Cl. ..... 346/153; 118/657

[58] Field of Search ..... 346/153, 154, 165, 162; 118/650, 651, 657, 658, 638

[56] References Cited

U.S. PATENT DOCUMENTS

| | | | |
|---|---|---|---|
| 2,910,903 | 11/1959 | Herman | 346/153 |
| 3,219,014 | 11/1965 | Mott et al. | 346/153 |
| 3,362,380 | 1/1968 | Anderson | 118/657 |
| 3,566,786 | 3/1971 | Kaufer et al. | 118/657 |
| 3,751,156 | 8/1973 | Szostak et al. | 118/651 |
| 3,906,121 | 9/1975 | Fraser et al. | 118/658 |
| 3,998,185 | 12/1976 | Weiler | 118/651 |
| 4,003,334 | 1/1977 | Samuels et al. | 118/658 |
| 4,018,187 | 4/1977 | Abbott | 118/658 |
| 4,108,658 | 8/1978 | Koeleman et al. | 118/657 |

*Primary Examiner*—John H. Wolff

[57] ABSTRACT

The recording apparatus of a type adopting a non-impact recording method comprises a recording electrode and a toner-bearing counter electrode, which are disposed with a predetermined gap therebetween, and recording is performed on a recording sheet, while the sheet is passed through the gap or recording portion, by the toner being attracted from the counter electrode to the recording sheet in accordance with a signal applied to the counter electrode from the recording electrode. On the surface of the counter electrode, in accordance with the invention there are formed an electrically conductive and ferromagnetic base portion and a number of non-conductive and non-magnetic convexities. The toner is deposited only on the base portion by suitable supply and scraper means, without exceeding the height of the convexities. Furthermore, a quenching charger for quenching charges held on the convexities is disclosed and the magnetic poles of each magnet disposed inside the counter electrode are directed so as to avoid the recording portion.

15 Claims, 15 Drawing Figures

RECORDING APPARATUS WITH IMPROVED COUNTER ELECTRODE

BACKGROUND OF THE INVENTION

The present invention relates to a recording apparatus, and more particularly to a non-impact recording apparatus.

Conventionally, a non-impact recording method is known, in which a counter electrode uniformly covered with a toner powder is disposed adjacent a recording electrode with a predetermined gap therebetween and a sheet-like or ribbon-like recording material is placed in the gap and the counter electrode is moved with the above-mentioned gap maintained while applying an image signal to the recording electrode and, at the same time, the recording material is moved, whereby a toner image corresponding to the applied image signal is formed on the surface of the recording material.

Referring to FIG. 1, there is shown a recording apparatus adopting such a recording method. In FIG. 1, a recording electrode 1 is shown as used in a receiving recorder of a facsimile system. The recording electrode 1 is a long and narrow plate extending perpendicularly to the plane of FIG. 1, and in the lower longitudinal end of the recording electrode 1, there are embedded multiple stylus electrodes. The respective ends of the multiple stylus electrodes are lined up with a very small space therebetween and in accordance with an image signal to be recorded, a potential is applied to a certain combination of the stylus electrodes.

As the recording electrode, a pin tube and a letter pattern can be employed as well.

In this conventional apparatus, a counter electrode 2 is shaped like a drum and is disposed axially parallel to the longitudinal axis of the recording electrode 1, with a predetermined gap maintained between the lower longitudinal end surface of the recording electrode 1 and the peripheral surface of the counter electrode 2, and the recording electrode 1 extends so as to cover the full length of the counter electrode 2.

The counter electrode 2 is rotatable in the direction of the arrow, and is rotated in the direction of the arrow with toner T held on the peripheral surface of the counter electrode 2 when image recording is made.

Recording material S is non-conductive and is transported in the direction of the arrow by a transporting system (not shown) during the image recording step. When the leading edge of the recording material S enters the gap between the recording electrode 1 and the counter electrode 2, this apparatus becomes ready for recording.

As the recording material, ordinary paper with an insulating film can be used. The recording material is shaped like a sheet or a ribbon. The ribbon-like recording material is not always narrow.

Powder toner T is conductive and magnetic and is attracted to the peripheral surface of the counter electrode 2 by a magnetic force of a magnet disposed inside the counter electrode 2. As the toner, a non-magnetic toner can be employed. However, the magnetic toner is more suitable for this recording apparatus since the magnetic toner can be easily supplied to the counter electrode 2. The use of a conductive toner is more advantageous than that of a toner with a high resistivity since it is unnecessary to charge the toner electrically during the image recording process.

When the recording apparatus is ready for recording, the back side of the recording material S is brought into contact with the stylus electrode embedded end surface of the recording electrode 1, while the front side of the recording material S is in light contact with or extremely close to the toner T deposited on the counter electrode 2.

In this condition, an image signal is applied to the recording electrode 1 and, at the same time, the recording material S is transported in the direction of the arrow at a predetermined speed and in synchronism with the transportation of the recording material S, the counter electrode 2 is rotated in the direction of the arrow.

In the gap between the recording electrode 1 and the counter electrode 2, namely in the recording portion of the apparatus, an electric field is formed locally in the direction perpendicular to the direction of movement of the non-conductive recording material S through the recording portion in accordance with an applied signal voltage. By the action of this electric field, the toner T on the counter electrode 2 is electrically charged. The toner T is then selectively transferred to the surface of the recording material S by the mutual action of the electric charge of the toner T and the above-mentioned electric field, in accordance with an image signal, whereby a toner image is formed on the recording material S. Therefore, when this toner image is fixed to the recording material S by some subsequent means, the image recording is completed.

In the case where a pin tube is employed as the recording electrode 1, an electric charge is applied to the back side of the recording material S in accordance with the image signal and the toner T is attracted to the recording material S by the mutual action of the charge applied to the recording material S and an electric charge induced electrostatically on the toner T. Thus, even in the case where the above-mentioned recording electrode 1 is employed, it is possible to perform recording by electrically charging the recording material S.

However, this recording system has the following potential problems. First, during the recording process, on one occasion, the toner layer on the counter electrode 2 may be brought into contact with the recording material S and on another occasion, the toner layer may be out of contact with the recording material S. This has some adverse effects on the image recording, which make the image density of a recording image ununiform and make it difficult to obtain a recording image with a high resolution. Furthermore, by the physical contact of the surface of the recording material S with the toner layer, a considerable background is caused in the recording image.

Such a background can be eliminated to some extent by differing the transportation speed of the recording material S from the moving speed of the toner T. In this case, however, it becomes difficult to obtain a recording image with a high image density.

In the case where a magnetic toner is employed, since a magnetic pole of the magnet for holding the toner T on the peripheral surface of the counter electrode 2 is located adjacent the recording portion, the toner T deposited on the recording material S for image formation is partly attracted back to the counter electrode 2 by the magnetic force of the magnet disposed inside the counter electrode 2. In order to prevent this, it is necessary to lengthen the application time of the pulse image signal in accordance with the width of a recording area.

This countermeasure, however, give a limitation to the speedup of recording.

SUMMARY OF THE INVENTION

It is therefore a principal object of the present invention to provide a recording apparatus capable of forming a recording image with a uniform image density and a high resolution and free from background.

In order to attain this purpose, in one embodiment of a recording apparatus according to the present invention, on the surface of a counter electrode, there are formed an electrically conductive and ferromagnetic base portion and a number of non-conductive and non-magnetic convexities, which project from the base portion. During a recording process, the top portions of the convexities are brought into contact with the recording material while the toner is maintained, lower than the convexities, in the base portion, whereby a direct physical contact of the toner with the recording material is obviated and accordingly the toner is always attracted to the recording material in a stable condition.

In another embodiment of a recording apparatus according to the present invention, in order to make the height of the toner layer constant within the base portion, a toner scraper means is provided for removing the toner deposited on the top portions of the convexities.

In a further embodiment, in order to surely prevent the toner from attaching to the top portions of the convexities, a quenching means is disposed adjacent the counter electrode.

Furthermore, in all the embodiments of a recording apparatus according to the present invention, it is avoided to direct a magnetic pole of any magnet disposed inside the counter electrode toward the recording portion of the recording apparatus.

DETAILED DESCRIPTION OF THE PREFERRED EMBODIMENTS

Figure 2:
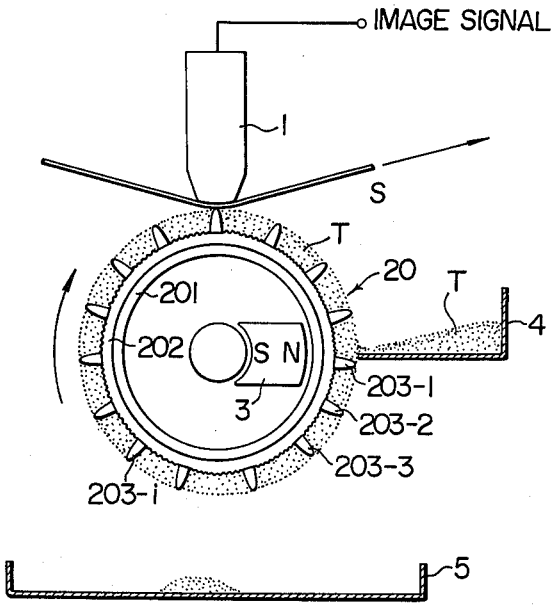
FIG. 2 is a schematic sectional side view of an embodiment of a recording apparatus according to the present invention.

Referring to FIG. 2, there is shown an embodiment of a recording apparatus according to the present invention. In FIG. 2, reference numeral 20 represents a counter electrode, and reference numeral 3 a magnet, and reference numeral 4 a toner supply means, and reference numeral 5 a toner receiving plate.

The counter electrode 20 comprises a supporter sleeve 201, and a cylindrical hollow base sleeve 202, made of a conductive and ferromagnetic material, such as nickel, cobalt and iron, which is fixedly mounted on the supporter sleeve 201.

On the peripheral surface of the cylindrical base sleeve 202, there are uniformly formed numerous non-conductive and non-magnetic tiny convexities 203-1, 203-2, . . . , **203-*i*, . . . . Hereinafter, each convexity is represented by 203-*i*** when discussing the convexities in general.

In the counter electrode 20, each convexity **203-*i* is designed to be of substantially the same height. The peripheral surface of the base sleeve 202 is referred to as "base portion" in contrast to the convexity 203-*i***.

The height of the respective convexities **203-*i* and the space between the respective convexities 203-*i* are in the range of from tens of micrometers to several millimeters. Each convexity 203-*i*** can be made of synthetic rubber, glass and ceramics or the like.

In this embodiment, the base portion is designed to undulate. The depth and the pitch of each undulation of the base portion are almost in the same range as the average particle size of the toner to be employed in this embodiment. More specifically, they are set in the range of from 0.5 to 300 $\mu$m depending upon the average particle size of the toner.

On the right side of the counter electrode 20 in FIG. 2, there is disposed the toner supply means 4. Toner T to be supplied to the counter electrode 20 is held on a shelf portion of the toner supply means 4. The toner T is composed of conductive and magnetic toner particles. The toner T being conductive here means that the toner T has a $10^7$ $\Omega$cm or less, perferably $10^4$ $\Omega$cm or less of volume resistivity in an electric field of 200 v/cm.

Inside the counter electrode 20, a magnet 3 is fixedly disposed in a predetermined position in such a fashion that one magnetic pole of the magnet 3 is directed to the toner supply means 4. The magnet 3 is shaped like a long and narrow rod disposed perpendicular to the plane of FIG. 2 and is magnetized in the direction perpendicular to the longitudinal side of the magnet 3.

The toner T is attracted to the counter electrode 20 from the toner supply means 4 by the magnetic force of the magnet 3, whereby the toner T is held on the base portion. Since the cylindrical hollow base sleeve 202 is ferromagnetic, it is easily magnetized in the magnetic field of the magnet 3, so that the toner T is continuously held securely on the base portion when the toner T on the base portion goes beyond the magnetic field of the magnet 3 as the counter electrode 20 is rotated in the direction of the arrow.

One end portion of the shelf of the toner supply means 4, facing the counter electrode 20, serves as a doctor blade, such that any quantity of toner which goes above the convexity **203-*i* is not held on the counter electrode 20, but the toner T is held only on the base portion of the peripheral portion of the counter electrode 20**.

As the counter electrode 20 is rotated in the direction of the arrow, a portion of the toner T, which cannot be held on the base portion by the magnetic force of the magnetized base portion, falls onto the toner receiving plate 5.

A gap between a recording electrode 1 and the counter electrode 20 is set in accordance with the thickness of a recording sheet S, namely in the range of from approximately 3 μm to 3000 μm. The gap here means a gap between an end surface of the recording electrode 1 and the top of the convexity **203-*i* which is located most adjacent the end surface of the recording electrode 1**.

When this recording apparatus is performing a recording process, the end surface of the recording electrode 1 is in contact with a back side of the recording sheet S, while the convexity **203-*i* is in contact with a front side of the recording sheet S. Therefore, as mentioned previously, since the upper portion of the toner T held on the base portion of the recording electrode 20 does not go above the top of the convexity 203-*i***, a predetermined small gap can be maintained between the toner T and the recording sheet S. Therefore, a physical contact of the recording sheet S with the toner T is effectively obviated and, accordingly, some disadvantages, which may be caused by the physical contact of the recording sheet S with the toner T, are obviated.

By this recording method, a high image density and a high resolution can be obtained, and a toner deposition on the background can be prevented. Furthermore, image density can be made uniform. Since the convexities **203-*i*** are not either conductive nor magnetizable, they do not have any adverse effect on the recording process.

Furthermore, since a magnetic pole of the magnet 3 having a strong magnetic force is not located near the recording portion, it is unnecessary to lengthen the application time of a pulse of an image signal, so that a high speed recording can be attained. In the conventional recording method, the pulse application time is in the order of a millisecond, while in the recording method of the present invention, it is in the order of 10μ seconds to 100μ seconds.

Furthermore, in the present invention, an applied voltage employed as an image signal is in the range of 20 to 3000 volts, perferably in the range of 20 to 1500 volts, or either direct current and alternating current can be employed equally.

The small concavities and convexities, namely the base portion concavities and the convexities **203-*i*, in the counter electrode 20** can be formed by a machining method, a chemical corrosion method and an electric surface treatment method.

Figure 1:
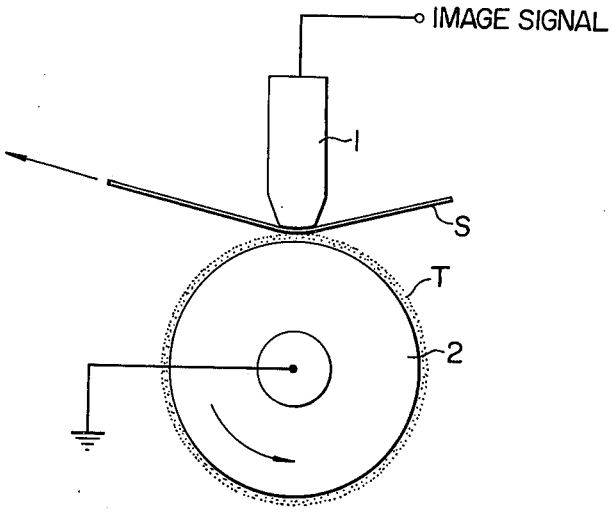
FIG. 1 PRIOR ART
FIG. 1 is a schematic sectional side view of a prior art recording apparatus.
Figure 3:
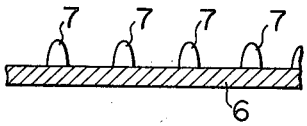
FIG. 3 is a schematic partial sectional side view of an example of a base portion and covexities formed on a counter electrode to be employed in the present invention.
Figure 4:
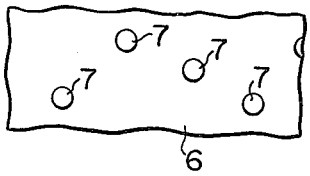
FIG. 4 is a partial plan view of FIG. 3.
Figure 5:
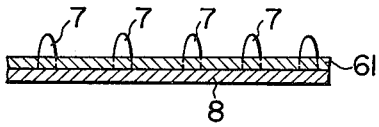
FIG. 5 is a schematic partial sectional side view of another example of a base portion to be employed in the present invention.
Figure 6:
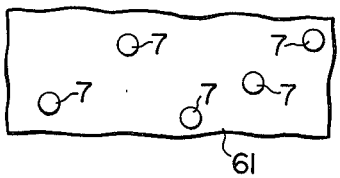
FIG. 6 is a partial plan view of FIG. 5.
Figure 7:
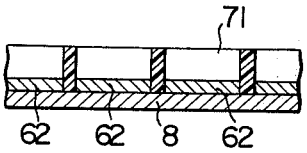
FIG. 7 is a schematic partial sectional side view of a further example of a base portion and convexities formed on a counter electrode to be employed in the present invention.
Figure 8:
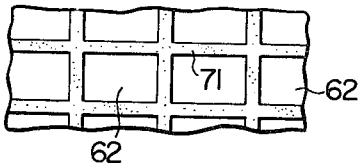
FIG. 8 is a partial plan view of FIG. 7.
Figure 9:
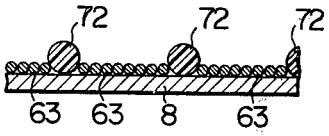
FIG. 9 is a schematic partial sectional side view of a further example of a base portion and convexities formed on a counter electrode to be employed in the present invention.
Figure 10:
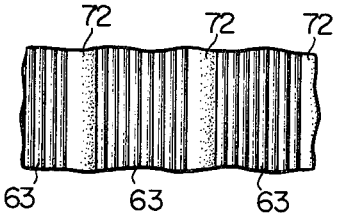
FIG. 10 is a partial plan view of FIG. 9.

FIG. 3 through FIG. 9 schematically show four examples of suitable forms for base portions and convexities. FIG. 3 is a schematic side view of the first example of FIG. 4 is a plan view of FIG. 3. FIG. 5 is a schematic side view of the second example and FIG. 6 is aplan view of FIG. 5. FIG. 7 is a schematic side view of the third example and FIG. 8 is a plan view of FIG. 7. FIG. 9 is a schematic side view of the fourth example and FIG. 10 is a plan view of FIG. 9.

In the first example shown in FIGS. 3 and 4, on a conductive and ferromagnetic base member 6, there are formed non-conductive and non-magnetic convexities 7. In the second example shown in FIGS. 5 and 6, the convexities 7 are projected from a support member 8, and a base member 61 is disposed between the convexities 7 projected from the support member 8. In the third example shown in FIGS. 7 and 8, a lattice convexity 71 is formed on the support member 8 and a base member 62 is disposed within the lattice convexity 71. The convexities can be designed in a connecting form as in the case of the third example. Also in this case, since each lattice unit of the convexity 71 is small and the convexity 71 is narrow, the convexity 71 is referred to as a fine convexity. In the fourth example, a convexity 72 is in the form of a thread extending linearly, and the base portion is composed of extremely thin thread-like members 63. It is preferable that the thickness of the thread-like members 63 is in the range of approximately 2μ to 30μ.

Experiments of the recording method according the present invention were conducted as follows.

EXPERIMENT 1

The recording apparatus employed in this experiment has such a construction as shown in FIG. 2. The concavities and convexities formed on the peripheral surface of the counter electrode 20 were as follows.

The pitch and the depth of the extremely small undulation on the peripheral surface of the cylindrical hollow base sleeve 202 were approximately 8μ.

The height of the convexities **203-*i*** and the space therebetween were approximately 70μ.

As the toner T, a conductive and magnetic toner powder was employed, whose volume resistivity was $5\times10^2\Omega$ cm in an electric field of 200 v/cm and whose average particle size was 8μ.

As the recording sheet S, a 50μ thick plan paper was used. Recording was conducted by applying image signals to the recording electrode 1 with an A.C. frequency of 100 kHz, an applied voltage of 600 V and a pulse application time of 30μ seconds.

As a result, a recording image with a high image density and a high image resolution, free from background, was obtained.

EXPERIMENT 2

Figure 11:
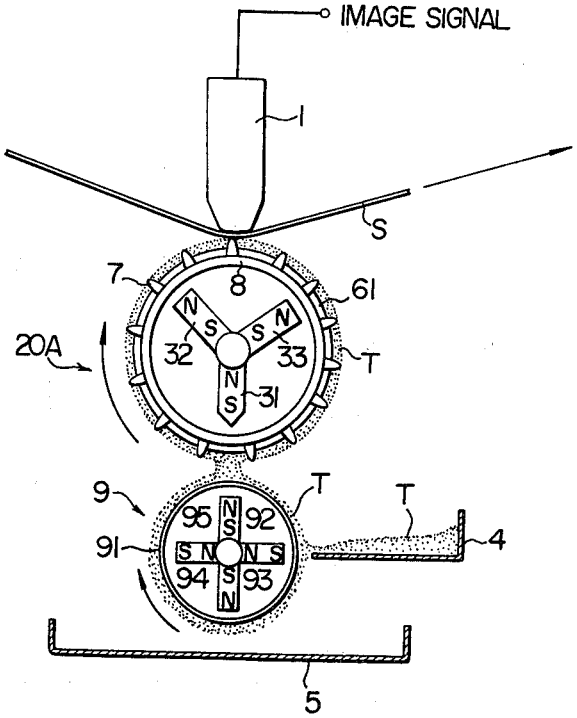
FIG. 11 is a schematic sectional side view of another embodiment of a recording apparatus according to the present invention.

In this experiment, a recording apparatus having such a construction as shown in FIG. 11 was employed. This recording apparatus is another embodiment of the present invention.

In FIG. 11, reference numeral 20A represents a counter electrode, and reference numeral 9 represents a toner supply roller. First, toner is supplied from the toner supply means 4 onto a non-magnetic sleeve 91 of the toner supply roller 9 by a magnetic force of a magnet 93. By the rotation of the sleeve 91 in the direction of the arrow, the toner is transported, while held on the sleeve 91 by the magnetic force of magnets 94, 95 and 92, and is then supplied onto the counter electrode 20A by the magnetic force of a magnet 31. Reference numerals 32 and 33 represent the other magnets, respectively.

The base member and the convexities in FIG. 11 are the same as shown in FIG. 5.

In this experiment, the height of the convexities 7 from the base member 61 and the space between the convexities 7 were set at 50μ, and the gap between an end portion of the shelf of the toner supply means 4 and the sleeve 91 was set at 0.8 mm and the minimum space between the convexities 7 and the counter electrode 20A was set at 1 mm.

Image signals were applied to the recording electrode 1 by a direct current from a negative (−) 300 volt source of applied voltage, while a D.C. positive (+) 300 volt source of bias voltage was applied to the base member 61, and the same toner T and the same recording sheet S as in Experiment 1 were employed. The results were the same as in Experiment 1.

Figure 14:
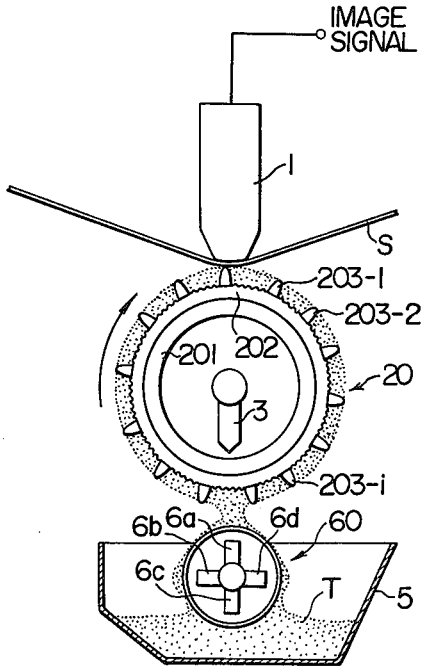
FIG. 14 is a schematic sectional side view of a further embodiment of a recording apparatus according to the present invention.

Referring to FIG. 14, there is shown a further embodiment of the present invention. In FIG. 14, the same reference numerals as in FIG. 2 represent the same members as those in FIG. 2, respectively. Reference numeral 5 represents a toner container and reference numeral 60 a toner supply roller. Furthermore, reference numeral 3 represents a magnet for supplying toner to the plane of the counter electrode 20.

The toner supply roller 60 is a non-magnetic sleeve having magnets 6*a*, 6*b*, 6*c* and 6*d* therein, and toner T is held on the non-magnetic sleeve by the magnetic force of the magnets 6*a*, 6*b*, 6*c* and 6*d* and is carried to a toner supplying portion as the sleeve is rotated.

Inside the counter electrode 20, there is fixedly disposed the magnet 3 for supplying toner in such manner as to face the toner supply roller 60. The magnet 3 is shaped long and narrow extending in the direction perpendicular to FIG. 14 as in the case of the magnets 6*a*, 6*b*, 6*c* and 6*d*, and is magnetized in the vertical direction perpendicular to the longitudinal direction of the magnet 3, and one magnet pole is directed to the toner supply roller 60.

The toner T conveyed to the toner supplying portion by the toner supply roller 60 is attracted to the peripheral surface of the counter electrode 20 by the magnetic force of the magnet 3 so that the peripheral surface of the counter electrode 20 is covered with the toner T. As the counter electrode 20 is rotated in the direction of the arrow, the toner T, held on the peripheral surface of the counter electrode 20 is carried to the recording portion.

Figure 12:
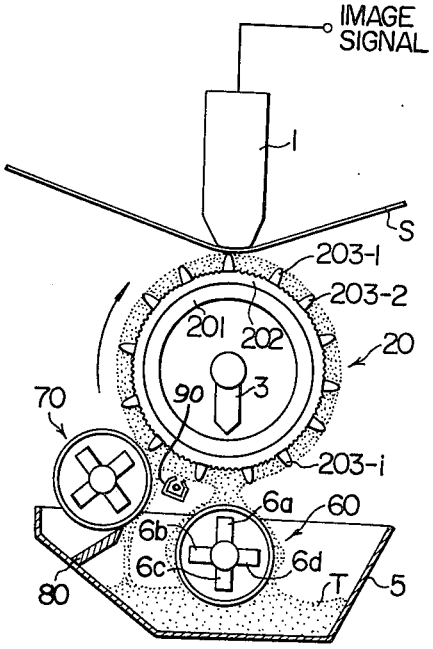
FIG. 12 is a schematic sectional side view of a further embodiment of a recording apparatus according to the present invention.

Referring to FIG. 12, a magnetic roller 70 is further disposed between the toner supplying portion and the recording portion, namely in a toner transportation path in the embodiment shown in FIG. 14. The magnetic roller 70 has a similar construction to that of the toner supply roller 60 and the peripheral surface of the magnetic roller 70 is located adjacent the peripheral surface of the counter electrode 20 so as to cover the full length of the counter electrode 20.

The magnetic roller 70 has the following function, which constitutes one of the features of the present invention. When the toner T covering the peripheral surface of the counter electrode 20 comes to the gap between the magnetic roller 70 and the counter electrode 20 with the rotation of the counter electrode 20, a magnetic force is applied to the toner T by the magnetic roller 70 in such manner that the toner T is separated from the counter electrode 20 against the magnetic force of the counter electrode 20, which attracts the toner T to the counter electrode 20.

Since the toner T is loosely held on the top of the convexity 203-*i*, all of the toner T deposited on the top of the convexity 203-*i* is trapped by the magnetic roller 70, and the toner T held on the base portion on the peripheral surface of the counter electrode 20 is partly trapped by the magnetic roller 70.

Thus, the magnetic roller 70 serves to adjust appropriately the quantity of the toner T to be held on the peripheral surface of the counter electrode 20 by removing some of the toner T from the counter electrode 20.

Figure 13:
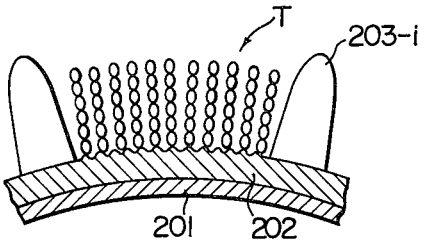
FIG. 13 is a schematic sectional side view of the convexities of a counter electrode according to the present invention, for explaining the function of a magnetic roller to be employed in the present invention.

In other words, the magnetic roller 70 has a function of removing excessive toner from the counter electrode 20. The magnetic roller 70 has not only the above-mentioned function but also another important function as follows. While the toner T remaining in the base portion on the peripheral surface of the counter electrode 20 is caused to pass through the gap between the counter electrode 20 and the magnetic roller 70, the toner particles of the toner T are arranged in the direction of the magnetic flux of the magnetic roller 70, namely in the direction normal to the base portion as shown in FIG. 13. An appropriate quantity of the toner T to be held on the counter electrode 20 is such a quantity as the top portion of the thus arranged toner particles does not go above the top of the convexities 203-*i*.

The toner trapped by the magnetic roller 70 is carried by the rotation of the magnetic roller 70 and is then scraped from the surface of the magnetic roller 70 by an edge of a blade 80 which is in pressure contact with the surface of the magnetic roller 70, so that the scraped toner is recovered into the toner container 5.

After the excessive toner has been removed, the toner T held on the counter electrode 20 is conveyed to the recording portion by the rotation of the counter electrode 20. During this step, the arrangement of the toner particles in the base portion is maintained as shown in FIG. 13. The gap between the recording electrode 1 and the counter electrode 20 is set in the range of approximately from 30 μm to 3000 μm in accordance with the thickness of the recording sheet S.

EXPERIMENT 3

By use of such an apparatus as shown in FIG. 12, a recording experiment was conducted under the following conditions.

The pitch and the depth of the extremely small undulations on the peripheral surface of the cylindrical hollow base sleeve 202 made of nickel were approximately 8μ.

The height of convexities 203-*i* made of ceramics and the space therebetween were approximately 50μ.

As the toner T, a conductive and magnetizable toner powder was employed, whose volume resistivity was $5\times10^2\Omega$ cm in an electric field of 200 v/cm and whose average particle size was 8μ.

As the recording sheet S, a 50μ thick plain paper was used. Recording was conducted by applying image signals to the recording electrode 1 with an A.C. frequency of 1 MHz, an applied voltage of 1200 V and a pulse application time of 30μ second. As a result, a recording image with a high density and a high image resolution and without background was obtained.

EXPERIMENT 4

Recording was conducted under the same conditions as in Experiment 3 except for the following. Image signals were applied to the recording electrode 1 with a 600 V applied voltage source of D.C. and with a 90μ second period of pulse application. The result was the same as in Experiment 3.

Figure 15:
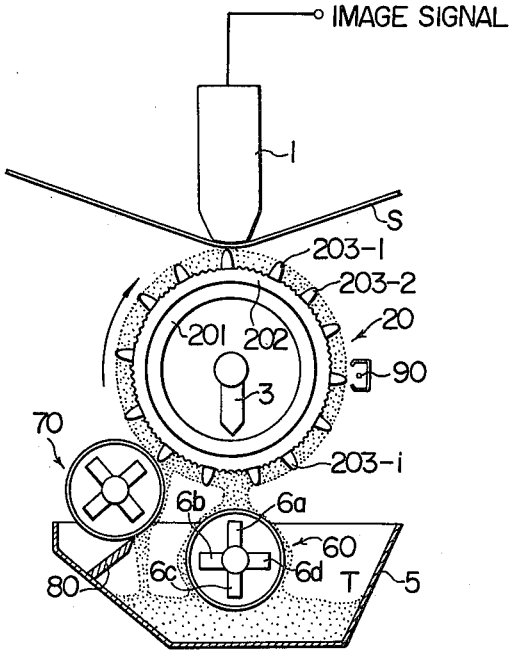
FIG. 15 is a schematic sectional side view of a further embodiment of a recording apparatus according to the present invention.

Referring to FIG. 15, there is shown a further embodiment of a recording apparatus according to the present invention, wherein as a quenching means, a quenching charger 90 is disposed in the toner transportation path between the recording portion and the toner supplying portion in the embodiment shown in FIG. 15. The inventor of the present invention investigated the cause of background and blurred images which occasionally occur in the embodiments described so far and found that the electrically charged convexities cause such background and blurred images.

To be more specific, since the convexities **203-*i* are non-conductive, they become charged triboelectrically while in contact with the recording sheet S and the toner T. As a result, the convexities 203-*i* electrically attract the toner thereto. The toner thus deposited on the convexities 203-*i* causes background in contact with the recording sheet S during the recording process. When the thus charged convexities 203-*i*** attract the toner deposited on the recording sheet S, blurred images are formed.

The quenching charger 90 serves to discharge the convexities **203-*i* after each of the convexities 203-*i* passes through the recording portion, whereby deposition of the toner T on the convexities 203-*i* is prevented and, at the same time, the toner T deposited on the convexities 203-*i* becomes easily removable from the convexities 203-*i*. The toner T in this condition is removed from the convexities 203-*i* by the magnetic brush formed in the toner supplying portion and by the attracting force of the magnetic roller 70**. Thus, in the recording apparatus of the present invention, the occurrence of the above-mentioned background and blurred images can be effectively obviated.

It is preferable that the quenching charger 90 is an A.C. charger.

The quenching means can be disposed between the toner supplying portion and the magnetic roller 70 as shown in FIG. 12.

As a matter of course, since all the toner deposited on the convexities **203-*i* cannot be removed from the convexities 203-*i* only by discharging the convexities 203-*i*, it is necessary to place some means for removing completely the toner from the convexities 203-*i* before the toner on the convexities 203-*i* reaches the recording portion again. However, since the above-mentioned magnetic brush and the magnetic roller 70** work as such a means, it is not always necessary to place such an exclusive means. When necessary, however, an air-nozzle apparatus, a fur brush and a blade plate can be employed.

While specific embodiments of the invention have been shown and described in detail to illustrate the application of the principles of the invention, it will be understood that the invention may be embodied otherwise without departing from such principles.

What is claimed is:

1. In a recording apparatus of the type using magnetic toner and comprising:

recording electrode means for applying image signals;

counter electrode means for holding the magnetic tone thereon and movable with a predetermined gap maintained between it and said recording electrode means; and a transporting means for passing a recording material through said gap in synchronism with the movement of said counter electrode means while an image signal is applied from said recording electrode means to said counter electrode means whereby a toner image corresponding to the image signal is formed on the magnetic toner held on said counter electrode means from said counter electrode means to said recording material in the area of said gap;

the improvement wherein said counter electrode means comprises:

an electrically conductive and ferromagnetic base portion on which the magnetic toner is held; and a plurality of non-conductive and non-magnetic convexities projecting outwardly from said base portion with substantially the same height and distributed uniformly throughout said base portion, and whose tip portions extend above the level of the magnetic toner held therebetween on said base portion and are brought into contact with the recording material when passing through said gap.

2. A recording apparatus as claimed in claim 1, wherein said counter electrode means further comprises an elongated member with at least one magnet therein, which magnet extends in the longitudinal direction of said member and has a magnetic pole directed toward said electrically conductive and ferromagnetic base portion other than in the area right under and near said gap.

3. A recording apparatus as claimed in claim 2, further comprising a toner supplying means disposed so as to face said magnetic pole of said magnet.

4. A recording apparatus as claimed in claim 3, wherein said toner supplying means comprises a shelf portion with one end directed toward said magnetic pole and adjacent said counter electrode means so as to serve as a doctor blade for removing excessive toner from said counter electrode means.

5. A recording apparatus as claimed in claim 3, wherein said toner supplying means comprises a toner supply roller comprising a non-magnetic sleeve having at least one magnet therein for attracting toner to said sleeve, said toner supply roller disposed adjacent said counter electrode means.

6. A recording apparatus as claimed in claim 3, further comprising a toner removing means for removing excessive toner from said counter electrode means.

7. A recording apparatus as claimed in claim 6, wherein said toner removing means comprises a magnetic roller disposed downstream of said toner supplying means in the direction of counter electrode means rotation and whose peripheral surface is disposed adjacent the top of said convexities, and a blade which is in pressure contact with the peripheral surface of said magnetic roller.

8. A recording apparatus as claimed in claim 7, further comprising a quenching means for quenching charges held on said convexities.

9. A recording apparatus as claimed in claim 8, wherein said quenching means is disposed between said gap and said toner supplying means.

10. A recording apparatus as claimed in claim 8, wherein said quenching means is disposed between said toner supplying means and said magnetic roller.

11. A recording apparatus as claimed in claim 3, further comprising a quenching means for quenching charges held on said convexities on said counter electrode means.

12. A recording apparatus as claimed in claim 11, wherein said quenching means is disposed between said gap and said toner supplying means.

13. A recording apparatus as claimed in claim 1, wherein said non-conductive and non-magnetic convexities are formed in a lattice form.

14. A recording apparatus as claimed in claim 1, wherein said non-conductive and non-magnetic convexities are composed of threads placed parallel to each other, and said electrically conductive and ferromagnetic base portion is composed of threads much thinner than said threads constituting said convexities.

15. A recording apparatus as claimed in claim 1, wherein said non-conductive and non-magnetic convexities are made of a material selected from the group consisting of synthetic resins, rubber, glass and ceramics.

* * * * *